US010355357B2

(12) United States Patent
Wang

(10) Patent No.: US 10,355,357 B2
(45) **Date of Patent: *Jul. 16, 2019**

(54) PRINTED CIRCUIT BOARD ANTENNA AND TERMINAL

(71) Applicant: Huawei Device Co., Ltd., Dongguan (CN)

(72) Inventor: Hanyang Wang, Shenzhen (CN)

(73) Assignee: Huawei Device Co., Ltd., Dongguan (CN)

( * ) Notice: Subject to any disclaimer, the term of this patent is extended or adjusted under 35 U.S.C. 154(b) by 83 days.

This patent is subject to a terminal disclaimer.

(21) Appl. No.: 15/461,297

(22) Filed: Mar. 16, 2017

(65) Prior Publication Data

US 2017/0229776 A1 Aug. 10, 2017

Related U.S. Application Data

(63) Continuation of application No. 14/517,418, filed on Oct. 17, 2014, now Pat. No. 9,666,951, which is a (Continued)

(51) Int. Cl.
*H01Q 1/00* (2006.01)
*H01Q 1/24* (2006.01)
(Continued)

(52) U.S. Cl.
CPC ..... *H01Q 5/357* (2015.01); *H01Q 1/242* (2013.01); *H01Q 1/38* (2013.01); *H01Q 5/314* (2015.01);
(Continued)

(58) Field of Classification Search
None
See application file for complete search history.

(56) References Cited

U.S. PATENT DOCUMENTS 5,489,913 A 2/1996 Raguenet et al.
6,140,966 A 10/2000 Pankinaho
(Continued)

FOREIGN PATENT DOCUMENTS

CN 1286508 A 3/2001
CN 1806367 A 7/2006
(Continued)

OTHER PUBLICATIONS

Behdad, Nader, "Design of Dual-Band Cavity-Backed Slot Antennas Using Lumped Elements", Jun. 9, 2007, 4 pages.
(Continued)

*Primary Examiner* — Trinh V Dinh
(74) *Attorney, Agent, or Firm* — Slater Matsil, LLP

(57) ABSTRACT

A printed circuit board antenna includes a printed circuit board and a feedpoint that is disposed on the printed circuit board. A copper coating is disposed on the printed circuit board. A split is disposed on the copper coating on the printed circuit board. The split is connected to a board edge of the printed circuit board. A slot perpendicular to the split is disposed on the copper coating on the printed circuit board. The slot is connected to the split. The copper coating at two sides of the split forms a first antenna and a second antenna. The feedpoint is configured to, together with the first antenna and the second antenna, form a first resonance loop and a second resonance loop. Resonance frequencies of the first resonance loop and the second resonance loop are different.

8 Claims, 8 Drawing Sheets

Related U.S. Application Data continuation of application No. PCT/CN2013/081193, filed on Aug. 9, 2013.

(51) Int. Cl.

| | |
|---|---|
| ***H01Q 5/357*** | (2015.01) |
| ***H01Q 13/10*** | (2006.01) |
| ***H01Q 21/30*** | (2006.01) |
| ***H01Q 5/314*** | (2015.01) |
| ***H01Q 13/16*** | (2006.01) |
| ***H01Q 5/378*** | (2015.01) |
| ***H01Q 1/38*** | (2006.01) |
| ***H01Q 7/00*** | (2006.01) |
| ***H01Q 9/04*** | (2006.01) |

(52) U.S. Cl.

CPC ..... *H01Q 5/378* (2015.01); *H01Q 7/00* (2013.01); *H01Q 7/005* (2013.01); *H01Q 9/0421* (2013.01); *H01Q 13/106* (2013.01); *H01Q 13/16* (2013.01); *H01Q 21/30* (2013.01)

(56) References Cited

U.S. PATENT DOCUMENTS

| | | | | |
|---|---|---|---|---|
| 6,346,914 | B1 | 2/2002 | Annamaa | |
| 6,452,554 | B1 | 9/2002 | Aoyama et al. | |
| 6,621,455 | B2 | 9/2003 | Wang et al. | |
| 7,256,743 | B2 | 8/2007 | Korva | |
| 7,872,605 | B2 * | 1/2011 | Baliarda | H01Q 9/0421 343/700 MS |
| 8,489,162 | B1 | 7/2013 | Dou et al. | |
| 8,750,798 | B2 | 6/2014 | Rao et al. | |
| 8,847,833 | B2 | 9/2014 | Korva et al. | |
| 9,666,951 | B2 * | 5/2017 | Wang | H01Q 5/357 |
| 2003/0034917 | A1 * | 2/2003 | Nishizawa | H01Q 1/38 343/700 MS |
| 2003/0112198 | A1 | 6/2003 | Wang et al. | |
| 2004/0239575 | A1 | 12/2004 | Shoji et al. | |
| 2005/0253757 | A1 * | 11/2005 | Liu | H01Q 1/243 343/700 MS |
| 2009/0153411 | A1 * | 6/2009 | Chiang | H01Q 1/243 343/702 |
| 2009/0174604 | A1 * | 7/2009 | Keskitalo | H01Q 1/243 343/700 MS |
| 2009/0256757 | A1 * | 10/2009 | Chiang | H01Q 1/2266 343/702 |
| 2010/0238072 | A1 * | 9/2010 | Ayatollahi | H01Q 1/243 343/700 MS |
| 2012/0068905 | A1 | 3/2012 | Ayatollahi et al. | |
| 2012/0326936 | A1 | 12/2012 | Tu | |
| 2013/0069836 | A1 | 3/2013 | Bungo | |
| 2013/0135158 | A1 | 5/2013 | Faraone et al. | |
| 2013/0307746 | A1 * | 11/2013 | Nakano | H01Q 1/2225 343/850 |
| 2014/0009343 | A1 * | 1/2014 | Iellici | H01Q 1/38 343/700 MS |
| 2014/0125528 | A1 * | 5/2014 | Tsai | H01Q 13/106 343/702 |

FOREIGN PATENT DOCUMENTS

| | | | |
|---|---|---|---|
| CN | 1812192 | A | 8/2006 |
| CN | 101123323 | A | 2/2008 |
| CN | 101359763 | A | 2/2009 |
| CN | 202384494 | U | 8/2012 |
| CN | 202503107 | U | 10/2012 |
| CN | 102800950 | A | 11/2012 |
| CN | 202997046 | U | 6/2013 |
| CN | 103199339 | A | 7/2013 |
| GB | 2401725 | A | 11/2004 |
| JP | H057110 | A | 1/1993 |
| JP | H05199031 | A | 8/1993 |
| JP | 2003163527 | A | 6/2003 |
| JP | 2004056421 | A | 2/2004 |
| JP | 2006217650 | A | 8/2006 |
| JP | 2006270760 | A | 10/2006 |
| JP | 2012039230 | A | 2/2012 |
| JP | 2013070365 | A | 4/2013 |
| KR | 101074331 | B1 | 10/2011 |
| WO | 0152353 | A2 | 7/2001 |

OTHER PUBLICATIONS

Azadegan, Reza et al., "A Novel Approach for Miniaturization of Slot Antennas", IEEE Transacations on Antennas and Propagation, vol. 51, No. 3, Mar. 1, 2003, 10 pages.

Behdad, Nader et al.,"Bandwidth Enhancement and Further Size Reduction of a Class of Miniaturized Slot Antennas", IEEE Transacations on Antennas and Propagation, vol. 52, No. 8. Aug. 2004, 8 pages.

Chu, Fang-Hsien et al.,"Internal Coupled-Fed Dual-Loop Antenna Integrated With a USB Connector for WWAN/LTE Mobile Handset", IEEE Transactions on Antennas and Propagation, vol. 59, No. 11, Nov. 2011, 7 pages.

Rehman, M. Ur et al.,"Effects of On-PCB location of radiating element on the performance of mobile terminal GPS antennas in multipath environment", Proceedings of the 5th European Conference on Antennas and Propagation (EUCAP), Apr. 11-15, 2011, 5 pages.

* cited by examiner

PRINTED CIRCUIT BOARD ANTENNA AND TERMINAL

CROSS-REFERENCE TO RELATED APPLICATIONS

This application is a continuation of U.S. patent application Ser. No. 14/517,418, filed on Oct. 17, 2014, which is a continuation of International Application No. PCT/CN2013/081193, filed on Aug. 9, 2013, all of the aforementioned applications are hereby incorporated by reference in their entireties.

TECHNICAL FIELD

Embodiments of the present invention relate to antenna technologies and, in particular embodiments, to a printed circuit board antenna and a terminal.

BACKGROUND

As mobile communications technologies develop, mobile terminals develop increasingly towards a direction of miniaturization, and more and more services are integrated into a mobile terminal. In this way, an antenna in a mobile terminal needs to have a compact size, a sufficient bandwidth, and a capability of working in multiple frequency bands.

Currently, there is a single frequency inverted-F antenna (IFA) that combines a printed circuit board (PCB), and the IFA antenna is a new type of antenna that is developed by combining characteristics of a planar inverted-F antenna (PIFA) and a monopole antenna. The IFA antenna has advantages of a monopole antenna in a small volume, high efficiency, and a sufficient bandwidth, and also has an advantage of a PIFA antenna in a strong anti-interference capability; therefore, the IFA antenna is suitable for a miniaturized mobile terminal.

However, a current mobile terminal possibly needs to work in multiple frequency bands such as the Bluetooth-wireless local area network (BT-WLAN), the Global Positioning System (GPS), and the high frequency Long Term Evolution (LTE). Therefore, a single frequency IFA antenna that combines the PCB is not suitable for a mobile terminal that works in multiple frequency bands.

SUMMARY

Embodiments of the present invention provide a printed circuit board antenna and a terminal, where the printed circuit board antenna can work in two different frequency bands at the same time.

According to a first aspect, a printed circuit board antenna includes a printed circuit board and a feedpoint that is disposed on the printed circuit board. A copper coating is disposed on the printed circuit board. A split is disposed on the copper coating on the printed circuit board. The split is connected to a board edge of the printed circuit board. A slot perpendicular to the split is disposed on the copper coating on the printed circuit board. The slot is connected to the split, and the copper coatings at two sides of the split forms, from the split to two ends of the slot, a first antenna and a second antenna. The feedpoint is configured to, together with the first antenna and the second antenna, form a first resonance loop and a second resonance loop. Resonance frequencies of the first resonance loop and the second resonance loop are different.

In a first possible implementation of the first aspect, the feedpoint is electrically connected to the first antenna, and the length of the first antenna is different from the length of the second antenna. The first resonance loop is formed on the first antenna through feeding of the feedpoint, and the second resonance loop is formed on the second antenna through coupled feeding of the first antenna, where the resonance frequencies of the first resonance loop and the second resonance loop are different.

With reference to the first aspect or the first possible implementation manner of the first aspect, in a second possible implementation manner, the antenna further includes a first inductor and a second inductor. The first inductor is disposed on the first antenna and is electrically connected to the first antenna and the second inductor is disposed on the second antenna and is electrically connected to the second antenna.

With reference to the second possible implementation manner of the first aspect, in a third possible implementation manner, the first inductor is disposed at a position with a maximum current on the first antenna, and the second inductor is disposed at a position with a maximum current on the second antenna.

With reference to the second or third possible implementation manner of the first aspect, in a fourth possible implementation manner, a resonance frequency of the first resonance loop decreases as an inductance of the first inductor increases, and a resonance frequency of the second resonance loop decreases as an inductance of the second inductor increases.

In a fifth possible implementation manner of the first aspect, a feeder is disposed at the split. The feedpoint is electrically connected to the feeder and the length of the first antenna is different from the length of the second antenna. The first resonance loop is formed on the first antenna through coupled feeding of the feeder, and the second resonance loop is formed on the second antenna through coupled feeding of the feeder. The resonance frequencies of the first resonance loop and the second resonance loop are different.

With reference to the fifth possible implementation manner of the first aspect, in a sixth possible implementation manner, the antenna further includes a first inductor and a second inductor. The first inductor is disposed on the first antenna and is electrically connected to the first antenna, and the second inductor is disposed on the second antenna and is electrically connected to the second antenna.

With reference to the sixth possible implementation manner of the first aspect, in a seventh possible implementation manner, the first inductor is disposed at a position with a maximum current on the first antenna, and the second inductor is disposed at a position with a maximum current on the second antenna.

With reference to the sixth or seventh possible implementation manner of the first aspect, in an eighth possible implementation manner, the resonance frequency of the first resonance loop decreases as an inductance of the first inductor increases, and the resonance frequency of the second resonance loop decreases as an inductance of the second inductor increases.

According to a second aspect, a terminal includes an antenna. The antenna includes a printed circuit board and a feedpoint that is disposed on the printed circuit board. A copper coating is disposed on the printed circuit board. A split is disposed on the copper coating on the printed circuit board. The split is connected to a board edge of the printed circuit board. A slot perpendicular to the split is disposed on the copper coating on the printed circuit board. The slot is connected to the split. The copper coatings at two sides of the split forms, from the split to two ends of the slot, a first antenna and a second antenna. The feedpoint is configured to, together with the first antenna and the second antenna, form a first resonance loop and a second resonance loop. Resonance frequencies of the first resonance loop and the second resonance loop are different.

In a first possible implementation manner of the second aspect, the feedpoint is electrically connected to the first antenna and the length of the first antenna is different from the length of the second antenna. The first resonance loop is formed on the first antenna through feeding of the feedpoint, and the second resonance loop is formed on the second antenna through coupled feeding of the first antenna, where the resonance frequencies of the first resonance loop and the second resonance loop are different.

With reference to the second aspect or the first possible implementation manner of the second aspect, in a second possible implementation manner, the antenna further includes a first inductor and a second conductor. The first inductor is disposed on the first antenna and is electrically connected to the first antenna, and the second inductor is disposed on the second antenna and is electrically connected to the second antenna.

With reference to the second possible implementation manner of the second aspect, in a third possible implementation manner, the first inductor is disposed at a position with a maximum current on the first antenna, and the second inductor is disposed at a position with a maximum current on the second antenna.

With reference to the second or third possible implementation manner of the second aspect, in a fourth possible implementation manner, a resonance frequency of the first resonance loop decreases as an inductance of the first inductor increases, and a resonance frequency of the second resonance loop decreases as an inductance of the second inductor increases.

In a fifth possible implementation manner of the second aspect, a feeder is disposed at the split, where the feedpoint is electrically connected to the feeder, and the length of the first antenna is different from the length of the second antenna. The feedpoint is configured to, together with the first antenna and the second antenna, form a first resonance loop and a second resonance loop. The first resonance loop is formed on the first antenna through coupled feeding of the feeder, and the second resonance loop is formed on the second antenna through coupled feeding of the feeder, where the resonance frequencies of the first resonance loop and the second resonance loop are different.

With reference to the fifth possible implementation manner of the second aspect, in a sixth possible implementation manner, the antenna further includes a first inductor and a second inductor. The first inductor is disposed on the first antenna and is electrically connected to the first antenna, and the second inductor is disposed on the second antenna and is electrically connected to the second antenna.

With reference to the sixth possible implementation manner of the second aspect, in a seventh possible implementation manner, the first inductor is disposed at a position with a maximum current on the first antenna, and the second inductor is disposed at a position with a maximum current on the second antenna.

With reference to the sixth or seventh possible implementation manner of the second aspect, in an eighth possible implementation manner, a resonance frequency of the first resonance loop decreases as an inductance of the first inductor increases, and a resonance frequency of the second resonance loop decreases as an inductance of the second inductor increases.

According to the printed circuit board antenna and the terminal that are provided by the embodiments of the present invention, a split and a slot perpendicular to the split are disposed on copper coating on a printed circuit board. The slot is connected to the split to form a first antenna and a second antenna. A feedpoint forms two resonance loops with different frequencies on the first antenna and the second antenna, so that the printed circuit board antenna can work in two different frequency bands at the same time.

BRIEF DESCRIPTION OF THE DRAWINGS

To describe technical solutions in embodiments of the present invention more clearly, the following briefly introduces accompanying drawings required for describing the embodiments. Apparently, the accompanying drawings in the following description show some embodiments of the present invention, and persons of ordinary skill in the art may still derive other drawings from these accompanying drawings without creative efforts.

DETAILED DESCRIPTION OF ILLUSTRATIVE EMBODIMENTS

To make objectives, technical solutions, and advantages of embodiments of the present invention clearer, the following clearly describes the technical solutions in the embodiments of the present invention with reference to accompanying drawings in the embodiments of the present invention. Apparently, the described embodiments are a part of the embodiments of the present invention rather than all of the embodiments. All other embodiments obtained by persons of ordinary skill in the art based on the embodiments of the present invention without creative efforts shall fall within the protection scope of the present invention.

A printed circuit board antenna and a metal frame antenna that are provided by the embodiments of the present invention can be disposed on a mobile terminal that needs to work in multiple wireless frequency bands, for example, a mobile terminal such as a mobile phone or a tablet computer. The multiple wireless frequency bands, for example, are frequency bands such as the BT-WLAN, the GPS, and the TD-LTE, where the BT-WLAN is in a frequency band of 2.4 GHz, the GPS is in a frequency band of 1575.42 MHz, and the TD-LTE is in a frequency band of 2.6 GHz.

Figure 1:
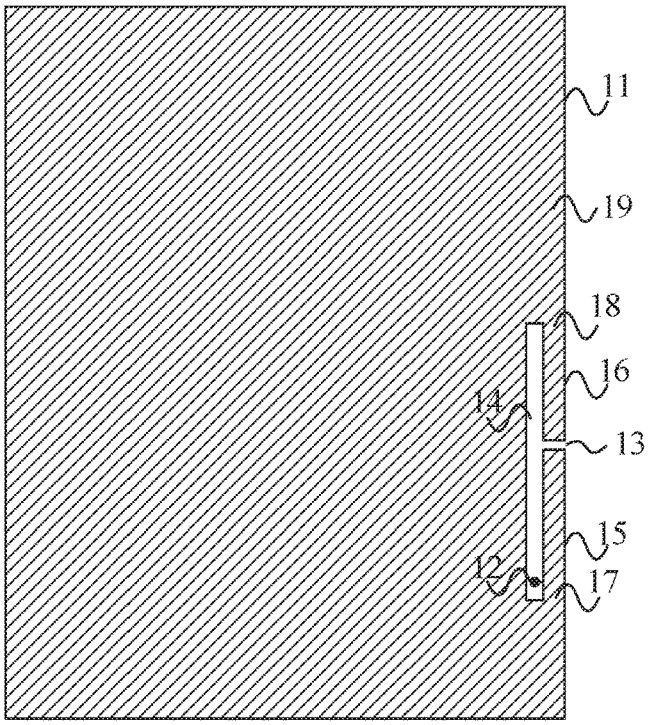
FIG. 1 is a schematic structural diagram of Embodiment 1 of a printed circuit board antenna according to an embodiment of the present invention.

FIG. 1 is a schematic structural diagram of Embodiment 1 of a printed circuit board antenna according to an embodiment of the present invention. As shown in FIG. 1, the printed circuit board antenna in this embodiment includes: a printed circuit board 11 and a feedpoint 12 that is disposed on the printed circuit board 11, where a copper coating 19 is disposed on the printed circuit board 11.

A split 13 is disposed on the copper coating 19 of the printed circuit board 11, the split 13 is connected to a board edge of the printed circuit board 11, a slot 14 perpendicular to the split 13 is disposed on the copper coating 19 of the printed circuit board 11, the slot 14 is connected to the split 13, and the copper coating 19 at two sides of the split 13 forms, from the split 13 to the slot 14, a first antenna 15 and a second antenna 16; and the feedpoint 12 is configured to, together with the first antenna 15 and the second antenna 16, form a first resonance loop and a second resonance loop, where resonance frequencies of the first resonance loop and the second resonance loop are different.

Specifically, the copper coating 19 is generally laid on places except lines and components on a printed circuit board of a mobile terminal, and the laid copper coating 19 is grounded. A part of the copper coating 19 is removed at a position at which there are no lines and components at one side edge of the printed circuit board 11, so as to dispose the split 13, where the split 13 is generally a rectangle. Similarly, a part of the copper coating 19 is removed from the printed circuit board 11, so as to dispose the slot 14, where the slot 14 is perpendicular to and is connected to the split 13, the slot 14 is generally also a rectangle, and the slot 14 and the split 13 form a structure of a "T" shape. In this way, at one side of the slot 14 that is located at the split 13, two separate segments of the copper coating 19 are formed, and the two segments of the copper coating 19 from the split 13 to the slot 14 are the first antenna 15 and the second antenna 16.

A position 17 on the first antenna 15 that is located at one end of the slot 14, and a position 18 on the second antenna 16 that is located at another end of the slot 14 are separately connected to remaining copper coating 19 on the printed circuit board 11, that is, the first antenna 15 and the second antenna 16 are respectively grounded at the position 17 and the position 18 at the two ends of the slot 14. A radio frequency circuit (not shown) configured to receive or generate a radio frequency signal is further disposed on the printed circuit board 11, and the radio frequency circuit is connected to the feedpoint 12, and transmits the radio frequency signal from the first antenna 15 and/or the second antenna 16 through the feedpoint 12, or receives, through the feedpoint 12, a radio frequency signal received by the first antenna 15 and/or the second antenna 16.

Manners in which the feedpoint 12 performs feeding to the first antenna 15 and the second antenna 16 can be classified into two forms. The first form may specifically be that: the feedpoint 12 is electrically connected to the first antenna 15, performs feeding to the first antenna 15 in a direct feeding manner, and forms the first resonance loop; and the first antenna 15 that accepts the direct feeding is used as an excitation source of the second antenna 16 to perform feeding to the second antenna 16 in a coupled feeding manner, and forms the second resonance loop. The second form may specifically be that: a feeder is disposed at the split 13, the feedpoint 12 is electrically connected to the feeder, and the first resonance loop and the second resonance loop are respectively formed on the first antenna 15 and the second antenna 16 through coupled feeding of the feeder. The following embodiments describe the two feeding manners separately.

A relationship between a resonance frequency generated by the antenna and the length of the antenna is $l=\lambda/4$ and $\lambda f=c$, where l is the length of the antenna, $\lambda$ is a wavelength of the resonance frequency generated by the antenna, f is the resonance frequency generated by the antenna, and c is the speed of light. Therefore, the wavelength of the resonance frequency generated by the antenna can be determined according to the resonance frequency generated by the antenna and the speed of light, and then the length of the antenna can be determined according to the wavelength. In this way, the lengths of the first antenna 15 and the second antenna 16 can be determined.

According to the printed circuit board antenna in this embodiment, the split 13 and the slot 14 are disposed on the copper coating 19 of the printed circuit board, so that the first antenna 15 and the second antenna 16 can be formed on the printed circuit board, the first resonance loop can be formed on the first antenna 15, and the second resonance loop can be formed on the second antenna 16, where the first resonance loop can generate a first resonance frequency, and the second resonance loop can generate a second resonance frequency, sizes of the first antenna 15 and the second antenna 16 are different, and the first resonance frequency generated by the first resonance loop is different from the second resonance frequency generated by the second resonance loop. In this way, a terminal device with the printed circuit board antenna according to this embodiment can work at two different frequencies, for example, the first resonance frequency is located in a BT-WLAN frequency band, and the second resonance frequency is located in a GPS frequency band.

According to the printed circuit board antenna in this embodiment, a split and a slot perpendicular to the split are disposed on a copper coating 19 on a printed circuit board, the slot is connected to the split to form a first antenna and a second antenna, and a feedpoint forms two resonance loops with different frequencies on the first antenna and the second antenna, so that the printed circuit board antenna can work in two different frequency bands at the same time.

On the printed circuit board antenna shown in FIG. 1, the feedpoint 12 is located in the slot 14 and is close to one end of the first antenna 15, the feedpoint 12 is electrically connected to the first antenna 15, a position at which the feedpoint 12 is electrically connected to the first antenna 15 is close to the position 17, and the length of the first antenna 15 is different from the length of the second antenna 16. An electrical connection exists between the first antenna 15 and the feedpoint 12. Therefore, the first resonance loop is formed on the first antenna 15 through direct feeding of the feedpoint 12. The first antenna 15 is grounded at the position 17; therefore, a resistance at the position 17 on the first antenna 15 that is located at one end of the slot 14 is the smallest, and a resistance at one end of the split 13 on the first antenna 15 is the largest. An impedance of the radio frequency circuit generally is 50 ohms.

To ensure impedance matching, the position at which the feedpoint 12 is electrically connected to the first antenna 15 should be as close to a position at which the impedance is 50 ohms and on the first antenna 15 as possible, where this position is close to the position 17. It can be known according to the formulas $l=\lambda/4$ and $\Delta f=c$ that, a frequency of the first resonance loop formed on the first antenna 15 is $c/4l_1$, where $l_1$ is the length of the first antenna 15. The second antenna 16 is not electrically connected to the feedpoint 12, the first antenna 15 is used as the excitation source (that is, the feedpoint) of the second antenna 16, and the second resonance loop is formed on the second antenna 16 through coupled feeding of the first antenna 15. When an electric field exists on the first antenna 15, one end of the split 13 on the second antenna 16 generates an electric field through a capacitive coupling effect. A shorter distance between the second antenna 16 and the first antenna 15 (that is, a narrower split 13) indicates that the first antenna 16 gets a stronger electric field coupling. In this way, the second resonance loop is generated on the second antenna 16. It can be known according to the formulas $l=\lambda/4$ and $\Delta f=c$ that, a frequency of the second resonance loop formed on the second antenna 16 is $c/4l_2$, where $l_2$ is the length of the second antenna 16. The lengths of the first antenna 15 and the second antenna 16 can be adjusted by adjusting sizes by which the slot 14 extends towards two sides of the split 13 and a size of the split 13, so that the resonance frequencies of the first resonance loop and the second resonance loop can be adjusted.

Figure 2:
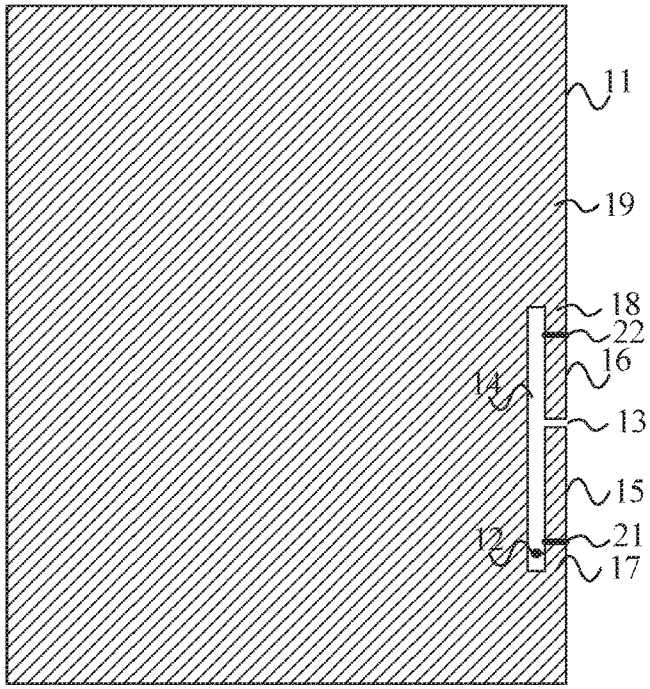
FIG. 2 is a schematic structural diagram of Embodiment 2 of a printed circuit board antenna according to an embodiment of the present invention.

FIG. 2 is a schematic structural diagram of Embodiment 2 of a printed circuit board antenna according to an embodiment of the present invention. As shown in FIG. 2, based on FIG. 1, the printed circuit board antenna in this embodiment further includes a first inductor 21 and a second inductor 22.

The first inductor 21 is disposed on the first antenna 15 and is electrically connected to the first antenna 15, and the second inductor 22 is disposed on the second antenna 16 and is electrically connected to the second antenna 16.

Specifically, an inductor component has two pins. The first inductor 21 is electrically connected to the first antenna 15, that is, two pins of the first inductor 21 are electrically connected to the first antenna 15. Similarly, the second inductor 22 is electrically connected to the second antenna 16, that is, two pins of the second inductor 22 are electrically connected to the second antenna 16. One inductor is connected to a point of the antenna, and inductive reactance of this inductor can offset all of or a part of capacitive reactance that is presented at the point by the antenna from the point to a free end of the antenna (using the first antenna 15 as an example, adding of the first inductor 21 can offset capacitive reactance that is presented at the first inductor 21 by the antenna from the first inductor 21 to the split 13), so that a current of the antenna from the point to an antenna ground point increases (using the first antenna 15 as an example, adding of the first inductor 21 increases a current of the antenna from the first inductor 21 to the position 17). That is, the effective length of the antenna is increased.

Therefore, disposing of the first inductor 21 and the second inductor 22 on the first antenna 15 and the second antenna 16 is equivalent to an increase of the lengths of the first antenna 15 and the second antenna 16, which decreases the resonance frequencies of the first resonance loop and the second resonance loop. In a case in which it is ensured that the resonance frequencies of the first resonance loop and the second resonance loop remain unchanged, if the first inductor 21 and the second inductor 22 are respectively disposed on the first antenna 15 and the second antenna 16, the lengths of the first antenna 15 and the second antenna 16 need to be shortened, that is, lengths by which the slot 14 extends towards two sides of the split 13 need to be shortened. Further, larger inductances of the first inductor 21 and the second inductor 22 correspondingly indicate narrower bandwidths of the first resonance loop and the second resonance loop.

In this way, by disposing the first inductor 21 and the second inductor 22 with appropriate inductances on the first antenna 15 and the second antenna 16, the lengths of the first antenna 15 and the second antenna 16 can be shortened under a precondition that the frequencies and the bandwidths of the first resonance loop and the second resonance loop are ensured, so that a size of the printed circuit board antenna can be reduced, which facilitates miniaturization of a mobile terminal with the printed circuit board antenna.

Further, one inductor is connected to a point of the antenna, and inductive reactance of this inductor can offset all of or a part of capacitive reactance that is presented at the point by the antenna from the point to the free end of the antenna, so that a current of the antenna from the point to the antenna ground point is increased, and therefore, an effect of offsetting the capacitive reactance on the antenna is the strongest when the inductor is disposed at a position with a maximum current on the antenna. Therefore, the first inductor 21 may be disposed at a position with a maximum current on the first antenna 15, and the second inductor 22 may be disposed at a position with a maximum current on the second antenna 16. In this way, the first inductor 21 and the second inductor 22 have the greatest influence on the lengths of the first antenna 15 and the second antenna 16.

Theoretically, the current is greater at a position closer to the antenna ground point; therefore, the first inductor 21 being closer to the position 17 indicates a greater influence on the length of the first antenna 15, and the second inductor 22 being closer to the position 18 indicates a greater influence on the length of the second antenna 16. In an actual application, the position at which the first inductor 21 is disposed on the first antenna 15 and the position at which the second inductor 22 is disposed on the second antenna 22 can be determined according to a requirement, which is not limited in the embodiments of the present invention.

According to the printed circuit board antenna in this embodiment, a split and a slot perpendicular to the split are disposed on a copper coating 19 on a printed circuit board, the slot is connected to the split to form a first antenna and a second antenna, and a feedpoint forms two resonance loops with different frequencies on the two antennas, so that the printed circuit board antenna can work in two different frequency bands at the same time, and on this basis, further, by disposing an inductor separately on the two antennas, the lengths of the antennas can be shortened in a case in which resonance frequencies generated by the antennas remain unchanged, so that a size of the printed circuit board antenna can be decreased.

Figure 3:
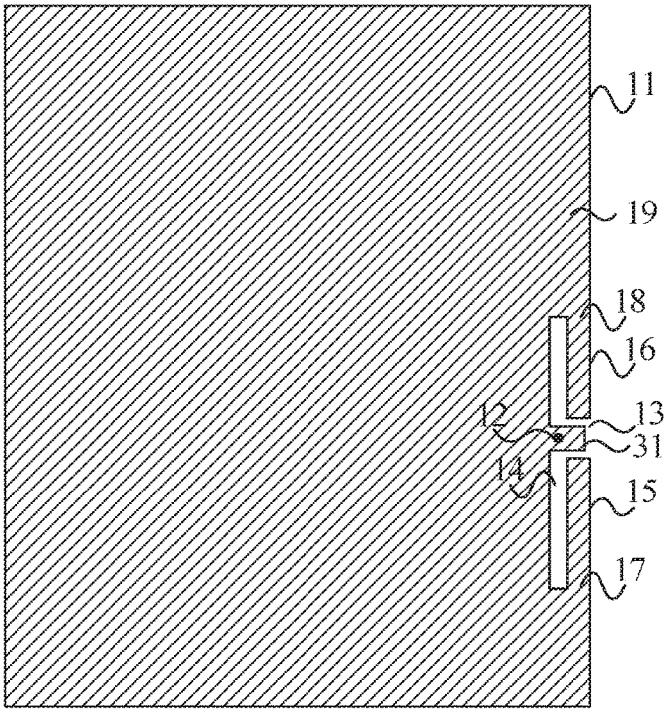
FIG. 3 is a schematic structural diagram of Embodiment 3 of a printed circuit board antenna according to an embodiment of the present invention.

FIG. 3 is a schematic structural diagram of Embodiment 3 of a printed circuit board antenna according to an embodiment of the present invention. As shown in FIG. 3, a difference between the printed circuit board antenna in this embodiment and the printed circuit board antenna shown in FIG. 1 lies in that a fever 31 is disposed at the split 13, the feedpoint 12 is disposed at a position on the slot 14 that is close to the split 13, the feedpoint 12 is electrically connected to the feeder 31, and the length of the first antenna 15 is different from the length of the second antenna 16.

Specifically, in this embodiment, both the first antenna 15 and the second antenna 16 perform feeding from the feedpoint 12 in the coupled feeding manner. To perform coupled feeding to the first antenna 15 and the second antenna 16, the feedpoint 12 needs to connect to a segment of feeder 31, where the feeder 31 is electrically connected to neither the first antenna 15 nor the second antenna 16. After accepting the direct feeding of the feedpoint 12, the feeder 31 separately performs coupled feeding to the first antenna 15 and the second antenna 16 through the capacitive coupling effect. The first resonance loop and the second resonance loop are respectively formed on the first antenna 15 and the second antenna 16.

In addition, it can be known according to the formulas $l=\lambda/4$ and $\Delta f=c$ that, the frequency of the first resonance loop formed on the first antenna 15 is $c/\lambda l_1$, where $l_1$ is the length of the first antenna 15, and the frequency of the second resonance loop formed on the second antenna 16 is $c/4l_2$, where $l_2$ is the length of the second antenna 16. The lengths of the first antenna 15 and the second antenna 16 can be adjusted by adjusting the sizes by which the slot 14 extends towards two sides of the split 13 and the size of the split 13, so that the resonance frequencies of the first resonance loop and the second resonance loop can be adjusted.

According to the printed circuit board antenna in this embodiment, a split and a slot perpendicular to the split are disposed on a copper coating 19 on a printed circuit board, the slot is connected to the split to form a first antenna and a second antenna, and a feedpoint forms two resonance loops with different frequencies on the two antennas, so that the printed circuit board antenna can work in two different frequency bands at the same time, and a dual-frequency printed circuit board antenna is provided.

Figure 4:
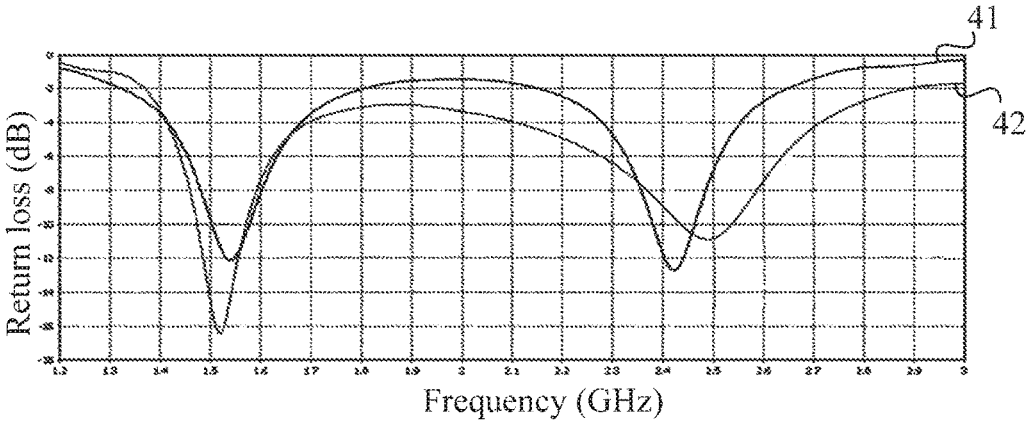
FIG. 4 shows simulation curve charts of return losses of the printed circuit board antennas shown in FIG. 1 and FIG. 3.

FIG. 4 is simulation curve charts of return losses of the printed circuit board antennas shown in FIG. 1 and FIG. 3. A size between a ground point of the first antenna 15 and a ground point of the second antenna 16 in the printed circuit board antenna shown in FIG. 1 is set to 63 mm, and widths of the first antenna 15 and the second antenna 16 are set to 5 mm; and a size between a ground point of the first antenna 15 and a ground point of the second antenna 16 in the printed circuit board antenna shown in FIG. 3 is set to 49 mm, and the widths of the first antenna 15 and the second antenna 16 are set to 5 mm, so that of the printed circuit board antennas shown in FIG. 1 and FIG. 3, the first antennas 15 both work in a GPS frequency band, and the second antennas 16 both work in a BT-WLAN frequency band, where a central frequency of the BT-WLAN frequency band is 2400 MHz, and a central frequency of the GPS frequency band is 1575.42 MHz.

In FIG. 4, a curve 41 indicates a curve of the return loss of the printed circuit board antenna shown in FIG. 1, and a curve 42 indicates a curve of the return loss of the printed circuit board antenna shown in FIG. 3. It can be seen from FIG. 4 that, a return loss in the curve 41 at a frequency of 1575.42 MHz is less than −10 dB, and a return loss in the curve 42 at the frequency of 1575.42 MHz is also less than −10 dB; and a return loss in the curve 41 at a frequency of 2.4 GHz is about −12 dB, and a return loss in the curve 42 at the frequency of 2.4 GHz is about −9 dB. It can be known according to return loss requirements of BT-WLAN and GPS antennas that, the printed circuit board antennas shown in FIG. 1 and FIG. 3 both can meet a requirement of working in dual frequency bands of the BT-WLAN and the GPS.

Figure 5:
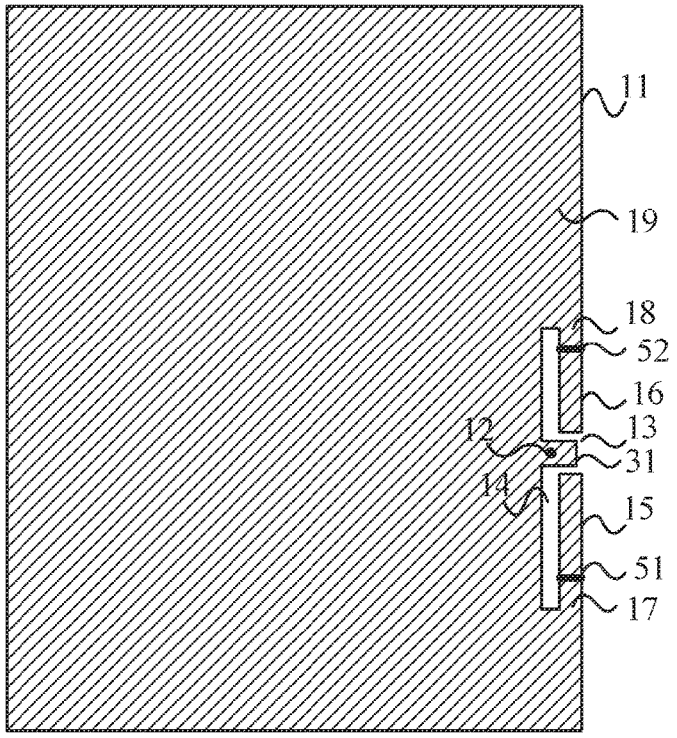
FIG. 5 is a schematic structural diagram of Embodiment 4 of a printed circuit board antenna according to an embodiment of the present invention.

FIG. 5 is a schematic structural diagram of Embodiment 4 of a printed circuit board antenna according to an embodiment of the present invention. As shown in FIG. 5, based on FIG. 3, the printed circuit board antenna in this embodiment further includes a first inductor 51 and a second inductor 52.

The first inductor 51 is disposed on the first antenna 15 and is electrically connected to the first antenna 15, and the second inductor 52 is disposed on the second antenna 16 and is electrically connected to the second antenna 16.

Specifically, an inductor component has two pins, and to electrically connect the first inductor 51 to the first antenna 15 is to electrically connect two pins of the first inductor 51 to the first antenna 15. Similarly, to electrically connect the second inductor 52 to the second antenna 16 is to electrically connect two pins of the second inductor 52 to the second antenna 16. One inductor is loaded at a point of the antenna, and inductive reactance of this inductor can offset all of or a part of capacitive reactance that is presented at the point by the antenna from the point to a free end of the antenna, so that a current of the antenna from the point to an antenna ground point is increased, that is, the effective length of the antenna is increased.

Therefore, disposing of the first inductor 51 and the second inductor 52 on the first antenna 15 and the second antenna 16 is equivalent to increasing of the lengths of the first antenna 15 and the second antenna 16, which decreases the resonance frequencies of the first resonance loop and the second resonance loop. In a case in which it is ensured that the resonance frequencies of the first resonance loop and the second resonance loop remain unchanged, if the first inductor 51 and the second inductor 52 are respectively disposed on the first antenna 15 and the second antenna 16, the lengths of the first antenna 15 and the second antenna 16 need to be shortened, that is, lengths by which the slot 14 extends towards two sides of the split 13 need to be shortened.

However, larger inductances of the first inductor 51 and the second inductor 52 correspondingly indicate narrower bandwidths of the first resonance loop and the second resonance loop. In this way, by disposing the first inductor 51 and the second inductor 52 with appropriate inductances on the first antenna 15 and the second antenna 16, the lengths of the first antenna 15 and the second antenna 16 can be shortened under a precondition that the frequencies and the bandwidths of the first resonance loop and the second resonance loop are ensured, so that a size of the printed circuit board antenna can be reduced, which facilitates miniaturization of a mobile terminal with the printed circuit board antenna.

Further, one inductor is loaded at a point of the antenna, and inductive reactance of this inductor can offset all of or a part of capacitive reactance that is presented at the point by the antenna from the point to the free end of the antenna, so that a current of the antenna from the point to the antenna ground point is increased, and therefore, an effect of offsetting the capacitive reactance on the antenna is the strongest when the inductor is disposed at a position with a maximum current on the antenna.

Therefore, the first inductor 51 may be disposed at a position with a maximum current on the first antenna 15, and the second inductor 52 may be disposed at a position with a maximum current on the second antenna 16; in this way, the first inductor 51 and the second inductor 52 have the greatest influence on the lengths of the first antenna 15 and the second antenna 16. Theoretically, the current is greater at a position closer to the antenna ground point; therefore, the first inductor 51 being closer to the position 17 indicates a greater influence on the length of the first antenna 15, and the second inductor 52 being closer to the position 18 indicates a greater influence on the length of the second antenna 16.

In the embodiment shown in FIG. 3, in a case in which the resonance frequency of the first resonance loop is in a GPS frequency band, and the resonance frequency of the second resonance loop is in a BT-WLAN frequency band, a size between a ground point of the first antenna 15 and a ground point of the second antenna 16 is 49 mm, and widths of the first antenna 15 and the second antenna 16 are set to 5 mm.

After the first inductor 51 and the second inductor 52 shown in FIG. 5 are introduced to an antenna of the foregoing size, the first inductor 51 is disposed at the position with the maximum current on the first antenna 15, and the inductance is 3 nH; the second inductor 52 is disposed at the position with the maximum current on the second antenna 16, and the inductance is 3.8 nH. In this case, the size between the ground point of the first antenna 15 and the ground point of the second antenna 16 is 37 mm, and the widths of the first antenna 15 and the second antenna 16 are set to 5 mm. That is, the resonance frequency of the first resonance loop can be in the GPS frequency band, and the resonance frequency of the second resonance loop can be in the BT-WLAN frequency band. It may be seen that, introduction of the inductor in this embodiment can significantly decrease the size of the antenna.

According to the printed circuit board antenna in this embodiment, a split and a slot perpendicular to the split are disposed on a copper coating 19 on a printed circuit board, the slot is connected to the split to form a first antenna and a second antenna, and a feedpoint forms two resonance loops with different frequencies on the two antennas, so that the printed circuit board antenna can work in two different frequency bands at the same time, and on this basis, further, by separately disposing one inductor on the two antennas, the lengths of the antennas can be shortened, so that a size of the printed circuit board antenna can be decreased.

Figure 6:
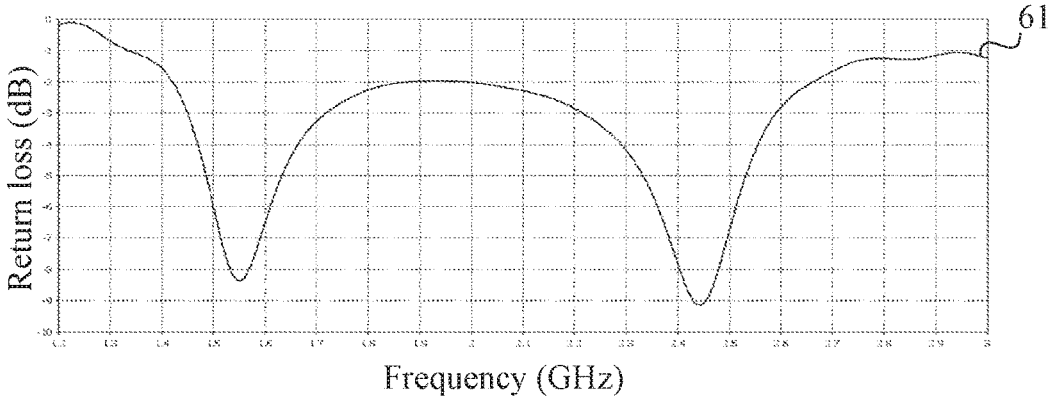
FIG. 6 is a simulation curve chart of a return loss of the printed circuit board antenna shown in FIG. 5.

FIG. 6 is a simulation curve chart of a return loss of the printed circuit board antenna shown in FIG. 5. In FIG. 6, a curve 61 is a simulation curve of a return loss when, in the printed circuit board antenna shown in FIG. 5, the size between the ground point of the first antenna 15 and the ground point of the second antenna 16 is 37 mm, the widths of the first antenna 15 and the second antenna 16 are set to 5 mm, and the first antenna 15 and the second antenna 16 separately work in the GPS and BT-WLAN frequency bands. It can be obtained by comparing the curve 61 with the curve 42 in FIG. 4 that, the printed circuit board antenna in the embodiment shown in FIG. 5 can still work in the BT-WLAN and GPS frequency bands at the same time; and although the return loss is slightly greater than that in the embodiment shown in FIG. 3, use requirements can still be met.

In addition, in the embodiments shown in FIG. 1 and FIG. 3, if positions of the split and the slot are adjusted to make the resonance frequencies of the formed first resonance loop and second resonance loop close to each other, it is equivalent to combination of frequency bands of the first resonance loop and the second resonance loop, so as to form a new frequency band with a wider bandwidth. In this way, the printed circuit board antennas in the embodiments shown in FIG. 1 and FIG. 3 can be extended to broadband antennas, which can meet a requirement of high-frequency diversity, and for example, are applicable to an application of a high-frequency band diversity antenna of LTE. Similarly, on this basis, the inductors shown in FIG. 2 and FIG. 5 can also be added to decrease the sizes of the antennas.

It should be noted that, in the foregoing embodiments, the lengths of the first antenna 15 and the second antenna 16 are different, so that the resonance frequencies generated by the first antenna 15 and the second antenna 16 are different. However, the printed circuit board antenna of the present invention is not limited thereto. In the printed circuit board antennas shown in FIG. 2 and FIG. 5, the first inductor 21 (51) and the second inductor 22 (52) are respectively added to the first antenna 15 and the second antenna 16, and the resonance frequencies generated by the first antenna 15 and the second antenna 16 are decreased.

Therefore, in another embodiment of the present invention, if a first antenna and a second antenna are formed by disposing a slot and a split, and the lengths of the first antenna and the second antenna are made the same; in this case, a first inductor and a second inductor are respectively added to the first antenna and the second antenna, and by adjusting magnitudes of inductances of the first inductor and the second inductor and adjusting positions at which the first inductor and the second inductor are located on the first antenna and the second antenna, resonance frequencies of a first resonance loop and a second resonance loop that are formed on the first antenna and the second antenna can still be made different.

Figure 7:
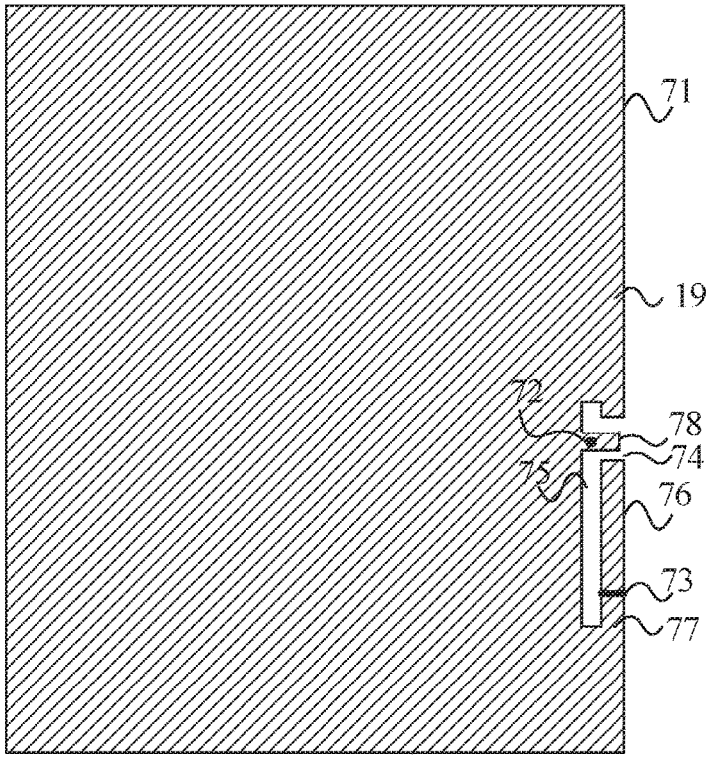
FIG. 7 is a schematic structural diagram of Embodiment 5 of a printed circuit board antenna according to an embodiment of the present invention.

FIG. 7 is a schematic structural diagram of Embodiment 5 of a printed circuit board antenna according to an embodiment of the present invention. As shown in FIG. 7, the printed circuit board antenna in this embodiment includes: a printed circuit board 71, and a feedpoint 72 and an inductor 73 that are disposed on the printed circuit board 71, where a copper coating 19 is disposed on the printed circuit board 71.

A split 74 is disposed on the copper coating 19 on the printed circuit board 71, the split 74 is connected to a board edge of the printed circuit board 71, a slot 75 perpendicular to the split 74 is disposed on the copper coating 19 on the printed circuit board 71, the slot 75 is connected to the split 74, and the copper coating 19 at one side of the split 74 forms, from the split 74 to the slot 75, an antenna 76; and a feeder 78 is disposed in the slot 75, the feedpoint 72 is electrically connected to the feeder 78, a resonance loop is formed on the antenna 76 through coupled feeding of the feeder 78, and the inductor 73 is disposed on the antenna 76 and is electrically connected to the antenna 76.

Specifically, a copper coating 19 is generally laid on places except lines and components on a printed circuit board of a mobile terminal, and the laid copper coating 19 is grounded. A part of the copper coating 19 is removed at a position at which there are no lines and components at one side edge of the printed circuit board 71, so as to dispose the split 74, where the split 74 is generally a rectangle. Similarly, a part of the copper coating 19 is removed from the printed circuit board 71, so as to dispose the slot 75, where the slot 75 is perpendicular to and is connected to the split 74, the slot 75 is generally also a rectangle, and the slot 75 and the split 74 form a structure of an "L" shape. In this way, at one side of the slot 75 that is located at the split 74, a segment of copper coating 19 with only one end connected to the printed circuit board is formed, and this segment of the copper coating 19 from the split 74 to one end 77 of the slot 75 is the antenna 76.

A position 77 at which the antenna 76 is located and that is at one end of the slot 75 is connected to a remaining copper coating 19 on the printed circuit board 71, that is, the position 77 on the antenna 76 at one end of the slot 75 is grounded. A radio frequency circuit (not shown) configured to receive or generate a radio frequency signal is further disposed on the printed circuit board 71, and the radio frequency circuit is connected to the feedpoint 72, and transmits the radio frequency signal from the antenna 76 by using the feedpoint 72, or receives, by using the feedpoint 72, a radio frequency signal received by the antenna 76. The feeder 78 is located in the split 74, the feeder 78 is not electrically connected to the antenna 76. After accepting direct feeding of the feedpoint 72, the feeder 78 performs coupled feeding to the antenna 76 through a capacitive coupling effect, and forms a resonance loop on the antenna 76. The inductor 73 has two pins, and to electrically connect the inductor 73 to the antenna 76 is to electrically connect the two pins of the inductor 73 to the antenna 76.

As shown in FIG. 7, the feedpoint 72 is connected to a segment of feeder 78, and performs feeding to the antenna 76 in a coupled feeding manner. The feedpoint 72 can further perform feeding to the antenna 76 in a direct feeding manner, where the direct feeding manner is similar to a manner in which the feedpoint 12 performs feeding to the first antenna 15 in FIG. 1, which will not be described in detail herein again.

In this embodiment, disposing of the inductor 73 on the antenna 76 is equivalent to an increase of the length of the antenna 76, which decreases a resonance frequency of the resonance loop formed on the antenna 76. In a case in which it is ensured that the resonance frequency of the resonance loop formed on the antenna 76 remains unchanged, if the inductor 73 is disposed on the antenna 76, the length of the antenna 76 needs to be shortened, that is, a length by which the slot 14 extends towards one side of the split 13 needs to be shortened. However, a larger inductance of the inductor 73 correspondingly indicates a narrower bandwidth of the resonance loop formed on the antenna 76. By disposing the inductor 73 with an appropriate inductance on the antenna 76, the length of the antenna 76 can be shortened under a precondition that the frequency and the bandwidth of the resonance loop formed on the antenna 76 are ensured, so that a size of the printed circuit board antenna can be decreased, which facilitates miniaturization of a mobile terminal that uses the printed circuit board antenna.

Further, one inductor is loaded at a point of the antenna, and inductive reactance of this inductor can offset all of or a part of capacitive reactance that is presented at the point by the antenna from the point to the free end of the antenna, so that a current of the antenna from the point to the antenna ground point is increased, and therefore, an effect of offsetting the capacitive reactance on the antenna is the strongest when the inductor is disposed at a position with a maximum current on the antenna. Therefore, the inductor 73 may be disposed at a position with a maximum current on the antenna 76; in this way, the inductor 73 has the greatest influence on the length of the antenna 76. Theoretically, the current is greater at a position closer to the antenna ground point; therefore, the inductor 73 being closer to the position 77 indicates a greater influence on the length of the antenna 76.

When the printed circuit board antenna shown in FIG. 7 works in a BT-WLAN frequency band, if the inductor 73 is not added, a size of the antenna 76 is 4 mm×23 mm; and after the inductor 73 with an inductance of 4.1 nH is added to the position with the maximum current on the antenna 76, the antenna is still enabled to work in the BT-WLAN frequency band, and the size of the antenna 76 can be decreased to 4 mm×16 mm. It may be seen that, introduction of the inductor in this embodiment can significantly decrease the size of the antenna.

Figure 8:
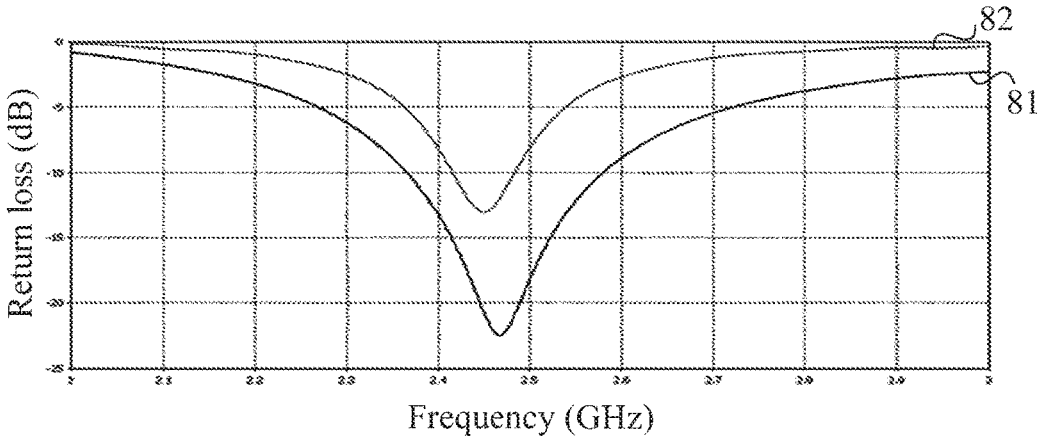
FIG. 8 is a simulation curve chart of a return loss of the printed circuit board antenna shown in FIG. 7.

FIG. 8 is a simulation curve chart of a return loss of the printed circuit board antenna shown in FIG. 7. As shown in FIG. 8, a curve 81 is a curve of a return loss of the printed circuit board antenna to which an inductor 73 is not added, a curve 82 is a curve of a return loss of the printed circuit board antenna to which the inductor 73 shown in FIG. 7 is added, and the antennas both work in a BT-WLAN frequency band; and a size of the antenna 76 to which the inductor 73 is not added is 4 mm×23 mm, and a size of the antenna 76 to which the inductor 73 with an inductance of 4.1 nH is added is 4 mm×16 mm. It can be obtained by comparing the curve 81 with the curve 82 that, the printed circuit board antenna to which the inductor 73 is added can still work in the BT-WLAN frequency band; and although the return loss is slightly greater than that of the printed circuit board antenna to which the inductor is not added, use requirements can still be met.

According to the printed circuit board antenna in this embodiment, one inductor is added to an IFA antenna, so that the length of a feeder can be shortened, so that a size of the printed circuit board antenna can be decreased.

Figure 9:
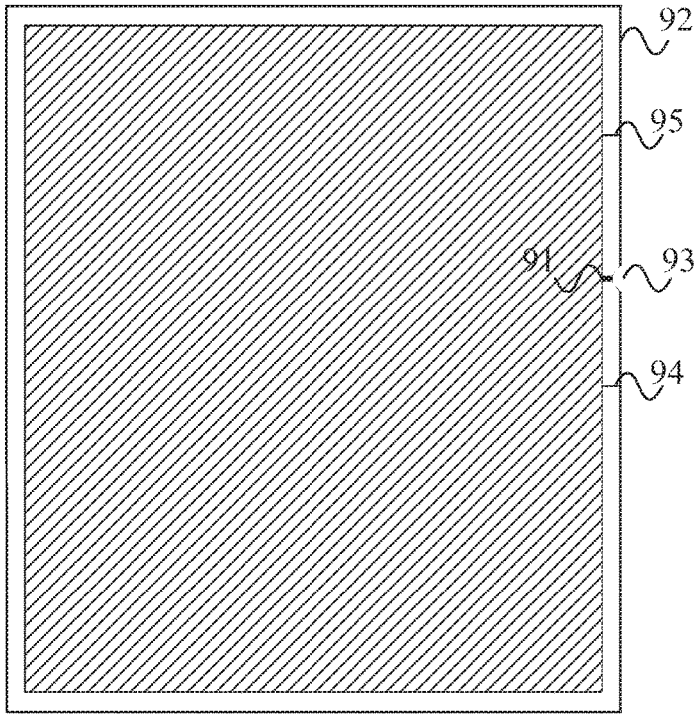
FIG. 9 is a schematic structural diagram of Embodiment 1 of a metal frame antenna according to an embodiment of the present invention.

FIG. 9 is a schematic structural diagram of Embodiment 1 of a metal frame antenna according to an embodiment of the present invention. As shown in FIG. 9, the metal frame antenna in this embodiment includes: a feedpoint 91 and a metal frame 92.

The metal frame 92 is generally an outer frame of a mobile terminal that uses the metal frame antenna. The feedpoint 91 is disposed on a printed circuit board in the mobile terminal, and is connected to a radio frequency circuit that is configured to receive or generate a radio frequency signal; a split 93 is disposed on the metal frame 92; a ground point 94 and a ground point 95 of the metal frame 92 that are at two sides of the split 93 are separately grounded; a metal frame between the feedpoint 91 and the ground point 94 can form a first resonance loop; and a metal frame between the feedpoint 91 and the ground point 95 can form a second resonance loop. By adjusting positions of the ground point 94 and the ground point 95 relative to the split 93, resonance frequencies of the first resonance loop and the second resonance loop can be adjusted, so that the metal frame antenna in this embodiment can generate two different resonance frequencies.

In this embodiment, an electrical connection exists between the feedpoint 91 and metal frames at two sides of the split 93, and the metal frames at the two sides of the split 93 form the first resonance loop and the second resonance loop through direct feeding of the feedpoint 91.

Figure 10:
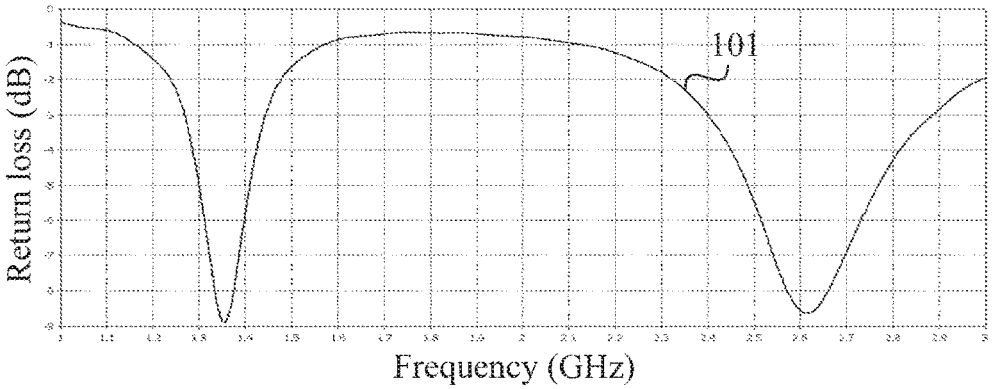
FIG. 10 is a simulation curve chart of a return loss of the metal frame antenna shown in FIG. 9.

FIG. 10 is a simulation curve chart of a return loss of the metal frame antenna shown in FIG. 9. As shown in FIG. 10, a curve 101 is a simulation curve of a return loss of the metal frame antenna shown in FIG. 9, and it may be seen that, the metal frame antenna shown in FIG. 9 can generate two different resonance frequencies, and return losses both meet a use requirement.

According to the metal frame antenna in this embodiment, a split is disposed on a metal frame, the metal frame is separately grounded at two sides of the split, and a feedpoint is electrically connected to the metal frame at the split, so that two resonance loops with different frequencies are formed on the metal frame, so that a dual-frequency metal frame antenna is provided.

Figure 11:
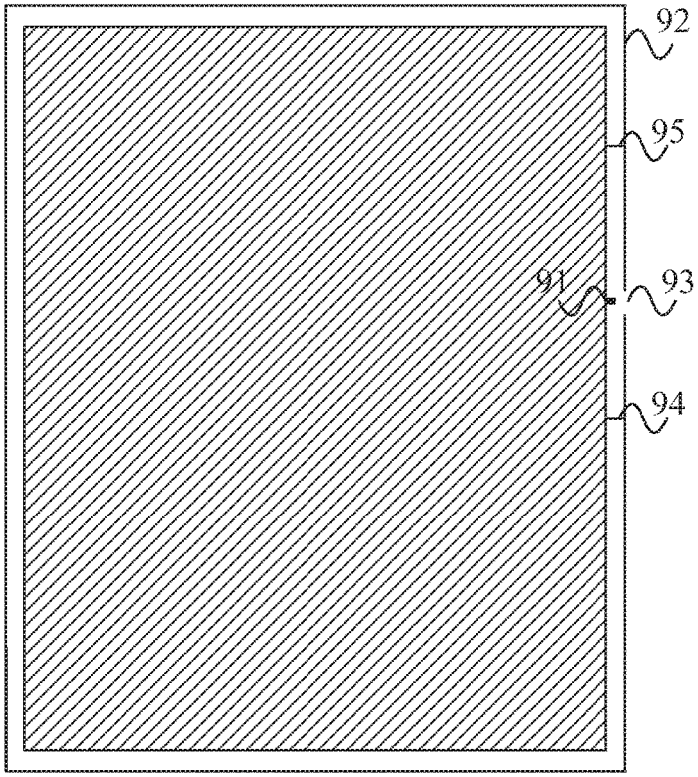
FIG. 11 is a schematic structural diagram of Embodiment 2 of a metal frame antenna according to an embodiment of the present invention.

FIG. 11 is a schematic structural diagram of Embodiment 2 of a metal frame antenna according to an embodiment of the present invention. As shown in FIG. 11, a difference between the metal frame antenna in this embodiment and the metal frame antenna shown in FIG. 9 lies in that: the feedpoint 91 is not electrically connected to the metal frames 92 at the two sides of the split 93, and the metal frames 92 at the two sides of the split 93 form the first resonance loop and the second resonance loop through coupled feeding of the feedpoint 91.

Figure 12:
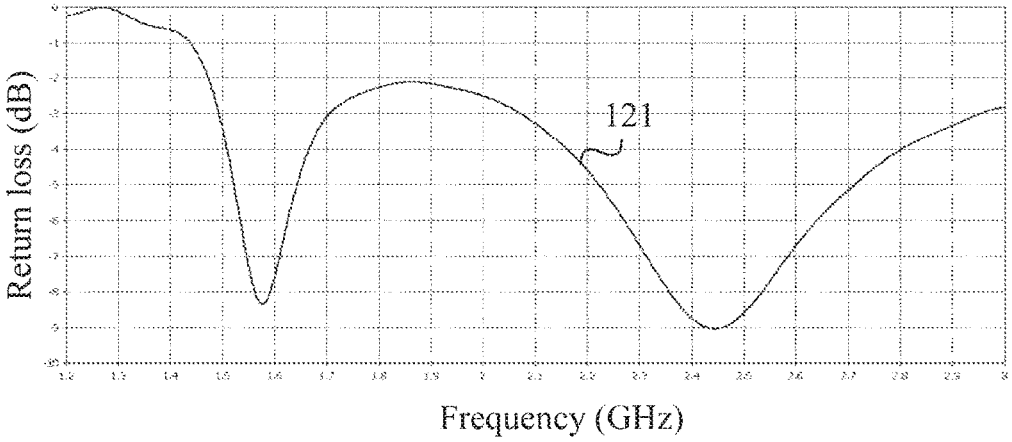
FIG. 12 is a simulation curve chart of a return loss of the metal frame antenna shown in FIG. 11.

FIG. 12 is a simulation curve chart of a return loss of the metal frame antenna shown in FIG. 11. As shown in FIG. 12, a curve 121 is a simulation curve of a return loss of the metal frame antenna shown in FIG. 11, and it may be seen that, the metal frame antenna shown in FIG. 12 can generate two different resonance frequencies, and return losses both meet a use requirement.

Figure 13:
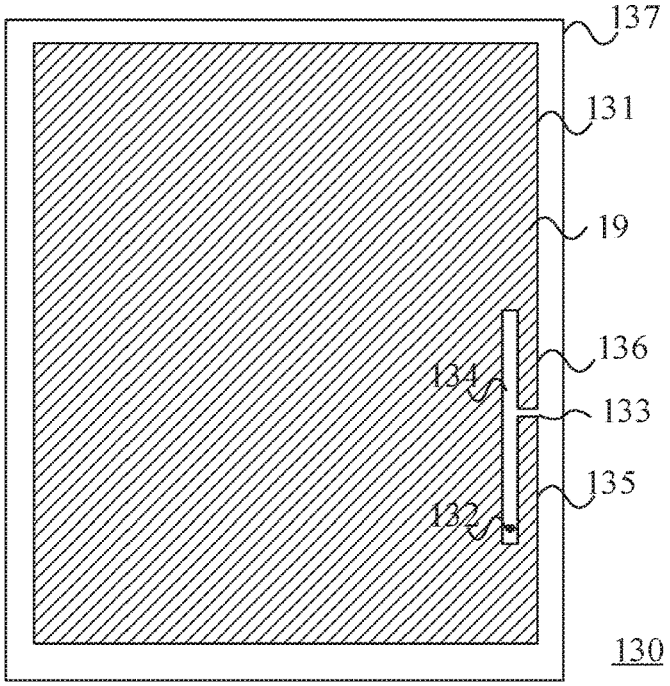
FIG. 13 is a schematic structural diagram of Embodiment 1 of a terminal according to an embodiment of the present invention.

FIG. 13 is a schematic structural diagram of Embodiment 1 of a terminal according to an embodiment of the present invention. As shown in FIG. 13, the terminal 130 in this embodiment includes an antenna. The antenna includes a printed circuit board 131 and a feedpoint 132 that is disposed on the printed circuit board 131, where a copper coating 19 is disposed on the printed circuit board 131. A split 133 is disposed on the copper coating 19 on the printed circuit board 131. The split 133 is connected to a board edge of the printed circuit board 131, a slot 134 perpendicular to the split 133 is disposed on the copper coating 19 on the printed circuit board 131. The slot 134 is connected to the split 133, and the copper coating 19 at two sides of the split 133 form, from the split 133 to two ends of the slot 134, a first antenna 135 and a second antenna 136; and the feedpoint 132 is configured to form, together with the first antenna 135 and the second antenna 136, a first resonance loop and a second resonance loop. Resonance frequencies of the first resonance loop and the second resonance loop are different.

In the terminal 130 shown in FIG. 13, the printed circuit board 131 can be used as a main board of the terminal 130, and components in the terminal 130 for completing various service functions, such as a processor, a memory, and an input\output device, are separately disposed on the printed circuit board 131 or are connected to another component by using the printed circuit board 131. The terminal 130 further includes a housing 137, and the foregoing components are all disposed in the housing 137.

The terminal 130 shown in this embodiment may be a mobile terminal device that needs to perform wireless communication, such as a mobile phone or a tablet computer, and an implementation principle and a technical effect of the antenna are similar to those of the printed circuit board antenna shown in FIG. 1, which will not be described in detail herein again. In addition, the antenna in the terminal 130 is formed by removing a part of the printed circuit board, and therefore the antenna has a simple structure, occupies small space, and is applicable to a miniaturized mobile terminal device.

The terminal provided by this embodiment includes a printed circuit board antenna, where a split and a slot perpendicular to the split are disposed on a copper coating 19 on a printed circuit board, the slot is connected to the split to form a first antenna and a second antenna, and a feedpoint forms two resonance loops with different frequencies on the two antennas, so that the printed circuit board antenna can work in two different frequency bands at the same time, so that the terminal can work in dual frequency bands at the same time.

Figure 15:
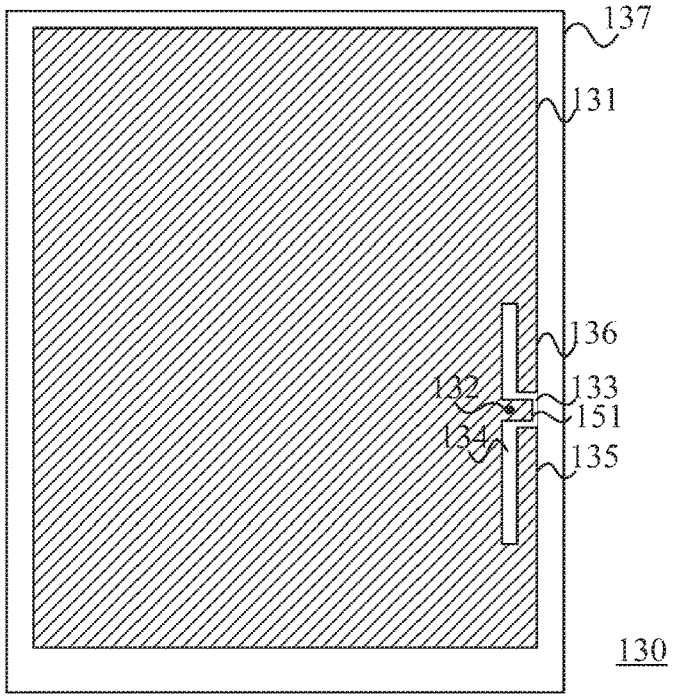
FIG. 15 is a schematic structural diagram of Embodiment 3 of a terminal according to an embodiment of the present invention.

In the terminal provided by the embodiment of the present invention, the antenna may have two forms, where the first form is shown in FIG. 13, and the second form is shown in FIG. 15.

In the embodiment shown in FIG. 13, specifically, the feedpoint 132 is electrically connected to the first antenna 135, and the length of the first antenna 135 is different from the length of the second antenna 136; and the first resonance loop is formed on the first antenna 135 through direct feeding of the feedpoint 132, the second resonance loop is formed on the second antenna 136 through coupled feeding of the first antenna 135, and resonance frequencies of the first resonance loop and the second resonance loop are different.

Figure 14:
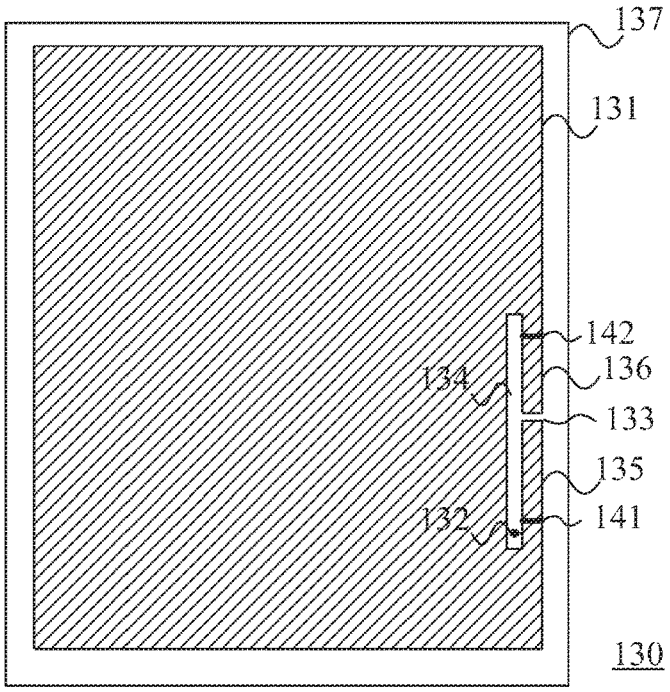
FIG. 14 is a schematic structural diagram of Embodiment 2 of a terminal according to an embodiment of the present invention.

FIG. 14 is a schematic structural diagram of Embodiment 2 of a terminal according to an embodiment of the present invention. As shown in FIG. 14, based on FIG. 13, in the terminal in this embodiment, the antenna further includes a first inductor 141 and a second inductor 142.

The first inductor 141 is disposed on the first antenna 135 and is electrically connected to the first antenna 135, and the second inductor 142 is disposed on the second antenna 136 and is electrically connected to the second antenna 136.

An implementation principle and a technical effect of the antenna in the terminal shown in this embodiment is similar to those of the printed circuit board antenna shown in FIG. 2, which will not be described in detail herein again.

Further, in the terminal shown in FIG. 14, the first inductor 141 is disposed at a position with a maximum current on the first antenna 135, and the second inductor 142 is disposed at the position with the maximum current on the second antenna 136.

Further, in the terminal shown in FIG. 14, the resonance frequency of the first resonance loop decreases as an inductance of the first inductor 141 increases, and the resonance frequency of the second resonance loop decreases as an inductance of the second inductor 142 increases.

FIG. 15 is a schematic structural diagram of Embodiment 3 of a terminal according to an embodiment of the present invention. As shown in FIG. 15, a difference between the terminal in this embodiment and the terminal shown in FIG. 13 lies in that, a feeder 151 is disposed at the split 133, the feedpoint 132 is disposed at a position on the slot 134 that is close to the split 133, the feedpoint 132 is electrically connected to the feeder 151, and the length of the first antenna 135 is different from the length of the second antenna 136.

An implementation principle and a technical effect of the antenna in the terminal shown in this embodiment is similar to those of the printed circuit board antenna shown in FIG. 3, which will not be described in detail herein again.

Figure 16:
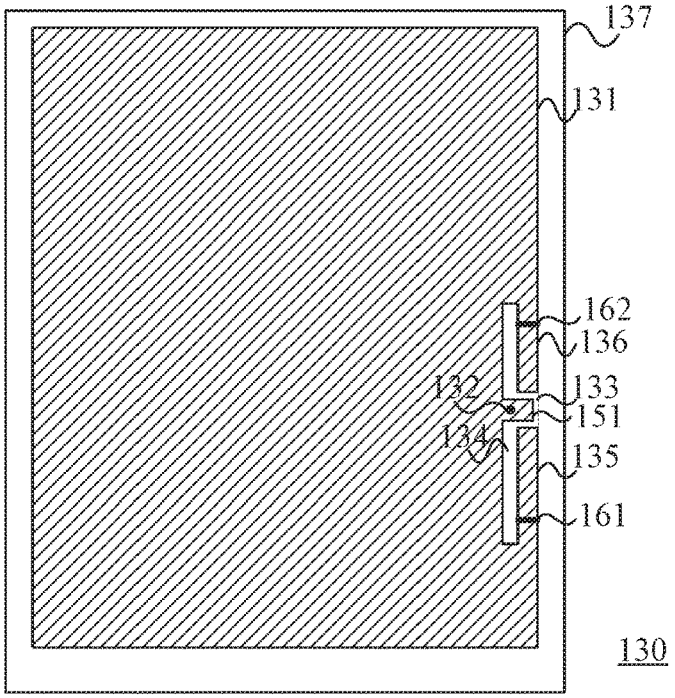
FIG. 16 is a schematic structural diagram of Embodiment 4 of a terminal according to an embodiment of the present invention.

FIG. 16 is a schematic structural diagram of Embodiment 4 of a terminal according to an embodiment of the present invention. As shown in FIG. 16, based on FIG. 15, in the terminal in this embodiment, the antenna further includes a first inductor 161 and a second inductor 162.

The first inductor 161 is disposed on the first antenna 135 and is electrically connected to the first antenna 135, and the second inductor 162 is disposed on the second antenna 136 and is electrically connected to the second antenna 136.

An implementation principle and a technical effect of the antenna in the terminal shown in this embodiment is similar to those of the printed circuit board antenna shown in FIG. 5, which will not be described in detail herein again.

Further, in the terminal shown in FIG. 16, the first inductor is disposed at a position with a maximum current on the first antenna, and the second inductor is disposed at a position with a maximum current on the second antenna.

Further, in the terminal shown in FIG. 16, the resonance frequency of the first resonance loop decreases as an inductance of the first inductor increases, and the resonance frequency of the second resonance loop decreases as an inductance of the second inductor increases.

It should be noted that, in the terminal embodiments shown in FIG. 13 to FIG. 16, the lengths of the first antenna 135 and the second antenna 136 are different, so that the resonance frequencies generated by the first antenna 135 and the second antenna 136 are different, and the terminal can work in two frequency bands at the same time. However, the terminal of the present invention is not limited thereto. In the terminals shown in FIG. 14 and FIG. 16, the first inductor 141 (161) and the second inductor 142 (162) are respectively added to the first antenna 135 and the second antenna 136, and the resonance frequencies generated by the first antenna 135 and the second antenna 136 are decreased.

Therefore, in another embodiment of the present invention, if a first antenna and a second antenna are formed by disposing a slot and a split, and the lengths of the first antenna and the second antenna are made the same; in this case, a first inductor and a second inductor are respectively added to the first antenna and the second antenna, and by adjusting magnitudes of inductances of the first inductor and the second inductor and positions at which the first inductor and the second inductor are located on the first antenna and the second antenna, resonance frequencies of a first resonance loop and a second resonance loop that are formed on the first antenna and the second antenna can still be made different.

Finally, it should be noted that the foregoing embodiments are merely intended for describing technical solutions of the present invention rather than limiting the present invention. Although the present invention is described in detail with reference to the foregoing embodiments, persons of ordinary skill in the art should understand that they may still make modifications to the technical solutions recorded in the foregoing embodiments or make equivalent replacements to a part of or all of the technical features thereof. Therefore, the protection scope of the present invention shall be subject to the protection scope of the claims.

What is claimed is:

1. A printed circuit board antenna comprising:

a printed circuit board having a copper coating;

a split disposed within the copper coating, the split being connected to a board edge of the printed circuit board, wherein a slot perpendicular to the split is disposed within the copper coating, the slot being connected to the split, wherein the copper coating at two sides of the split forms, from the split to two ends of the slot, a first antenna and a second antenna, and wherein a first resonant frequency of the first antenna is different from a second resonant frequency of the second antenna;

a first inductor and a second inductor, wherein the first inductor is disposed on the first antenna and is electrically connected to the first antenna, and the second inductor is disposed on the second antenna and is electrically connected to the second antenna; and a feedpoint disposed on the printed circuit board, wherein the feedpoint is coupled to the first antenna.

2. The printed circuit board antenna according to claim 1, wherein the feedpoint is electrically connected to the first antenna and a length of the first antenna is different from a length of the second antenna, and wherein a first resonance loop is formed on the first antenna through feeding of the feedpoint, and a second resonance loop is formed on the second antenna through coupled feeding of the first antenna.

3. A terminal comprising:

a printed circuit board antenna, comprising:

a printed circuit board having a copper coating;

a split disposed within the copper coating, the split being connected to a board edge of the printed circuit board, wherein a slot perpendicular to the split is disposed within the copper coating, the slot being connected to the split, wherein the copper coating at two sides of the split forms, from the split to two ends of the slot, a first antenna and a second antenna, and wherein a first resonant frequency of the first antenna is different from a second resonant frequency of the second antenna;

a first inductor and a second inductor, wherein the first inductor is disposed on the first antenna and is electrically connected to the first antenna, and the second inductor is disposed on the second antenna and is electrically connected to the second antenna; and a feedpoint disposed on the printed circuit board, wherein the feedpoint is coupled to the first antenna.

4. The printed circuit board antenna according to claim 1, wherein the first inductor is disposed at a position with a maximum current on the first antenna and the second inductor is disposed at a position with a maximum current on the second antenna.

5. The printed circuit board antenna according to claim 1, further comprising a feeder disposed at the split, wherein the feedpoint is electrically connected to the feeder, wherein a length of the first antenna is different from a length of the second antenna, and wherein a first resonance loop is formed on the first antenna through coupled feeding of the feeder and a second resonance loop is formed on the second antenna through coupled feeding of the feeder.

6. The terminal according to claim 3, wherein the first inductor is disposed at a position with a maximum current on the first antenna and the second inductor is disposed at a position with a maximum current on the second antenna.

7. The terminal according to claim 3, wherein the feedpoint is electrically connected to the first antenna and a length of the first antenna is different from a length of the second antenna, wherein a first resonance loop is formed on the first antenna through feeding of the feedpoint, and a second resonance loop is formed on the second antenna through coupled feeding of the first antenna, and wherein the resonance frequencies of the first resonance loop and the second resonance loop are different.

8. The terminal according to claim 3, wherein a feeder is disposed at the split, the feedpoint is electrically connected to the feeder, a length of the first antenna is different from a length of the second antenna, and wherein a first resonance loop is formed on the first antenna through coupled feeding of the feeder and a second resonance loop is formed on the second antenna through coupled feeding of the feeder.

* * * * *